US005656979A

United States Patent [19]

Nishimura

[11] Patent Number: 5,656,979

[45] Date of Patent: Aug. 12, 1997

[54] HIGH FREQUENCY POWER DISTRIBUTOR/ SYNTHESIZER

[75] Inventor: Hiroaki Nishimura, Tokyo, Japan

[73] Assignee: Hirose Electric Co., Ltd., Tokyo, Japan

[21] Appl. No.: 665,385

[22] Filed: Jun. 18, 1996

[30] Foreign Application Priority Data

Jun. 27, 1995 [JP] Japan ..... 7-160805

[51] Int. Cl.[6] ..... H01P 5/12

[52] U.S. Cl. ..... 333/127; 333/128

[58] Field of Search ..... 333/127, 128, 333/136, 25, 26, 125

[56] References Cited

U.S. PATENT DOCUMENTS 5,126,704 6/1992 Dittmer et al. ..... 333/128 X

OTHER PUBLICATIONS

Beckwith et al., Wide Bandwidth Monolithic Power Dividers, Microwave Journal, Feb. 1989, pp. 155–157, 160.

*Primary Examiner*—Paul Gensler

*Attorney, Agent, or Firm*—Kanesaka & Takeuchi

[57] ABSTRACT

A high frequency power distributor/synthesizer includes a first terminal useful as an input or output terminal for high frequency power; second and third terminals useful as outputs or inputs for high frequency power; high frequency transmission lines connected between the first terminal and the second or third terminal; a balance resistor connected between the second and third terminals; and a coil connected between the second and third terminals in parallel to the balance resistor to improve isolation and return loss without substantial influence on insertion loss of the distributor/ synthesizer.

2 Claims, 3 Drawing Sheets

HIGH FREQUENCY POWER DISTRIBUTOR/ SYNTHESIZER

BACKGROUND OF THE INVENTION

1. Field of the Invention

The present invention relates to high frequency power distributors/synthesizers and, especially, to improvements in the isolation characteristic of h-f power distributors/ synthesizers.

2. Description of the Related Art

Recently, an increasing number of h-f power distributors/ synthesizers are being used to divide or combine h-f power in digital mobile phone stations. There is a demand for good isolation characteristic for such h-f power distributors/ synthesizers.

Japanese patent application Kokai No. 123201/86 discloses such a h-f power distributor/synthesizer as shown in FIG. 2. This h-f power distributor works as both distributor and synthesizer, but description is made on only the aspect of a distributor. The distributor includes an input terminal 11, two distribution terminals 12 and 13, and a main circuit between them. The main circuit has a configuration of the so-called Willkinson distribution circuit which consists of two ¼ wavelength long lines 22 and 23 which branch out of a line 21 connected to the input terminal 11 and a balance resistor 24. The distributor further includes an auxiliary circuit 25 connected between the distribution terminals 12 and 13. The auxiliary circuit 25 consists of a serial connection of a variable capacitor, a variable phase shifter, and a variable coupling capacitor.

When h-f power is fed to the distribution terminal 12 where a load of 50 ohms is connected to the input terminal 11, a leak electric wave damped by 20–30 dB is output at the distribution terminal 13 if the auxiliary circuit 25 does not work as a regulator. Thus, the coupling degree of the variable capacitor of the auxiliary circuit 25 is adjusted so that an amplitude is equal to that of the leak electric wave and the variable phase shifter is adjusted so that the electric waves have opposite phases. As a result, the electric waves from the main circuit and the auxiliary circuit 25, respectively, in the same amplitude and opposite phase are synthesized at the distribution terminal 13 to offset each other, thereby providing a coupling attenuation of 60 dB or more.

Such a conventional h-f power distributor/synthesizer has a good isolation characteristic but requires a complicated auxiliary circuit including a variable capacitor and a variable phase shifter. Also, the improvement in the isolation characteristic is obtained at the expense of the optimum insertion loss. Thus, the conventional h-f power distributor/ synthesizer is not suitable for use in digital mobile phone stations.

The above Japanese patent also proposes to provide an isolator at the distribution terminal to improve the isolation characteristic of the Willkinson distributor so that the input signal is not leaked to the other distribution terminal. This method, however, requires an additional component or isolator, making the system more complex. Also, this method disturbs the insertion loss so that it is difficult to improve the isolation characteristic while keeping the optimum insertion loss.

The Willkinson distributor regulates the isolation characteristic by impedance match so that it is difficult to improve the isolation characteristic with the insertion loss kept optimum.

SUMMARY OF THE INVENTION

Accordingly, it is an object of the invention to provide a h-f power distributor/synthesizer free from the above disadvantage.

According to the invention there is provided a high frequency power distributor/synthesizer which includes a first terminal useful as an input or output terminal for high frequency power; second and third terminals useful as outputs or inputs for high frequency power; high frequency transmission lines connected between the first terminal and the second or third terminal; a balance resistor connected between the second and third terminals; and a coil connected between the second and third terminals in parallel to the balance resistor to improve isolation and return loss without substantial influence on insertion loss of the distributor/ synthesizer.

DESCRIPTION OF THE PREFERRED EMBODIMENT

Figure 1:
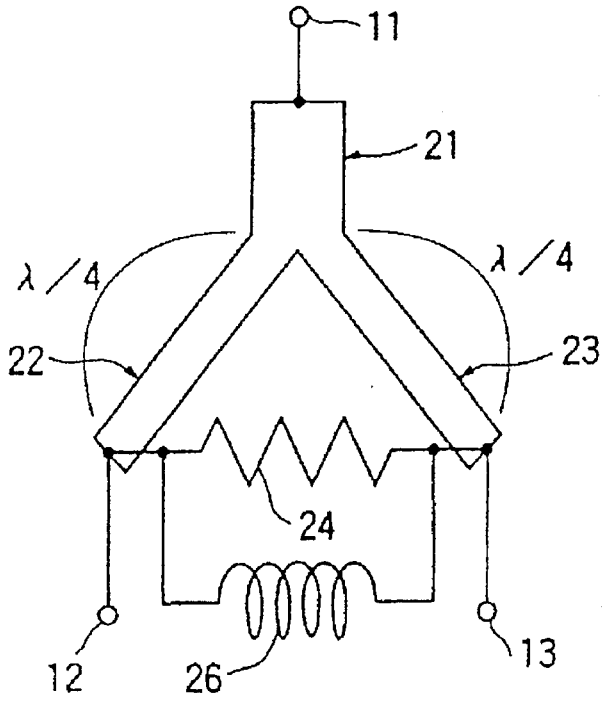
FIG. 1 is a schematic diagram of a h-f power distributor/ synthesizer according to an embodiment of the invention.
Figure 2:
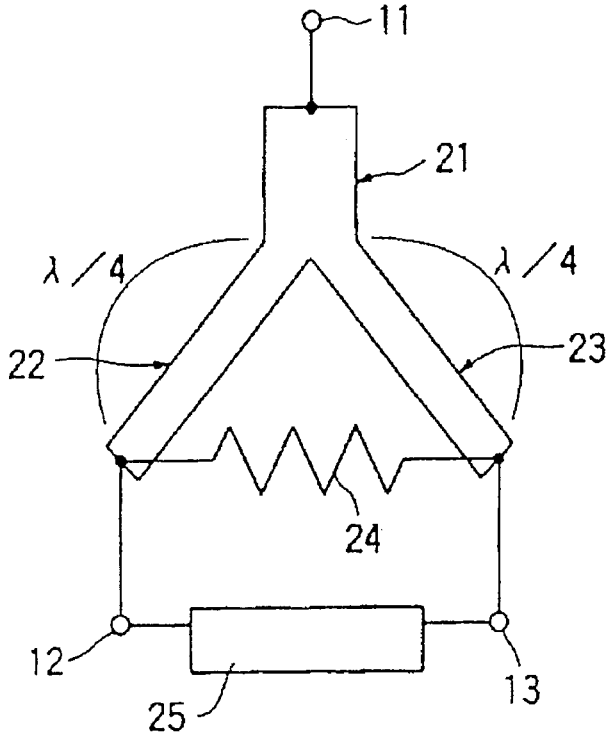
FIG. 2 PRIOR ART
FIG. 2 is a schematic diagram of a conventional h-f power distributor/synthesizer.

In FIG. 1, a h-f power distributor/synthesizer includes a first terminal 11 which serves as an input or output terminal for h-f power, second and third terminals 12 and 13 which serve as output or input terminals for h-f power, respectively, h-f transmission lines 22 and 23 connected between the first terminal 11 and the second terminal 12 or third terminal 13, a balance resistor 24 connected between the second and third terminals 12 and 13, and a coil 26 connected across the second and third terminals 12 and 13 in parallel to the balance resistor 24.

The h-f transmission lines 22 and 23 branch out of a h-f transmission line 21 and have a length of ¼ wavelength. The h-f transmission lines 21, 22, and 23 are made from stripline and have a resistance of 50 ohms, 70.7 ohms and 70.7 ohms, respectively. The resistance of balance resistor 24 is 100 ohms.

Where the h-f power distributor/synthesizer is used as a distributor, the important characteristics to evaluate the performance are the insertion loss (Ins), the isolation characteristic (ISO), and the return loss (R.L).

The ideal insertion loss is 3 dB (which is equal to ½). For example, if an input of a magnitude of 1 is fed to the first terminal 11, the ideal output at the second or third terminal 12 or 13 has a magnitude of ½. Thus, the closer the output to 3 dB, the better the insertion loss.

The ideal isolation characteristic means that when a signal of a certain magnitude is input to the second or third terminal 12 or 13, no signal is output at the other terminal 13 or 12 while a signal of the same magnitude is output at the first terminal 11. The higher the absolute value of dB, the better the isolation characteristic.

The return loss is defined by the magnitude of a reflected signal when a signal is input to the terminal 11, 12, or 13. The higher the absolute value of a return loss, the better the performance.

Figure 3:
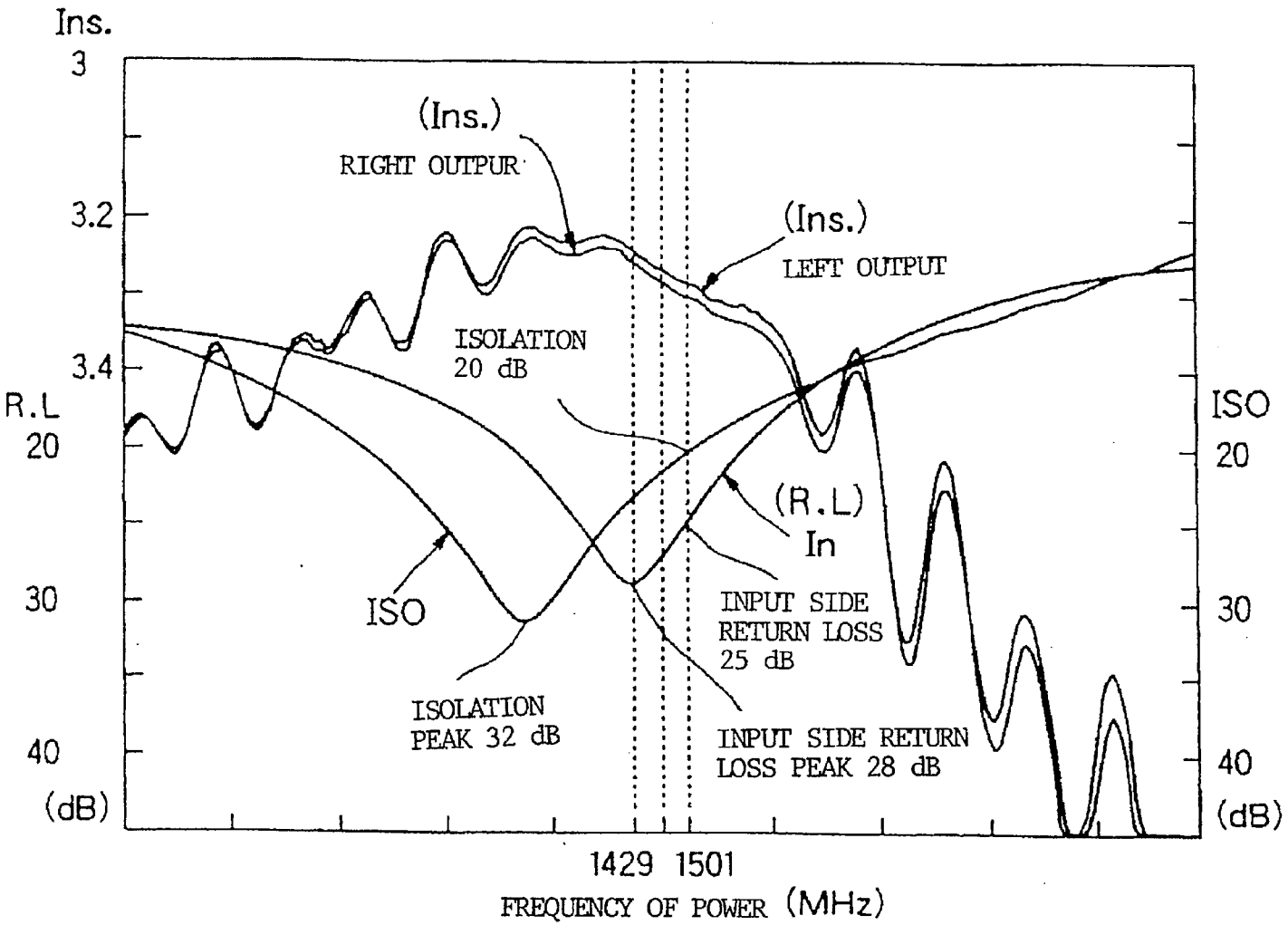
FIG. 3 is a graph showing the insertion loss, the isolation characteristic, and the return loss of a distributor with no coil equipped according to the invention.

FIG. 3 shows how the insertion loss (Ins), the isolation characteristic (ISO), and the return loss (R.L) of a distributor without the coil 26 vary with the frequency of power used. For the insertion loss there are two curves representing the left output from the first terminal 11 to the second terminal 12 and the right output from the first terminal 11 to the third terminal 13. The frequency of power used in this example ranges from 1429 MHz to 1501 MHz, with the central frequency at 1465 MHz.

From FIG. 3 it is apparent that the worst value of isolation in the frequency band is 20 dB, the peak value of isolation characteristic is 32 dB, the worst value of return loss in the frequency band is 25 dB, and that the peak value of return loss is 28 dB. The insertion loss ranges from about 3.24 dB to about 3.3 dB. When the isolation is as poor as 20 dB, there is a large amount of signal leak, causing a breakdown in the forward part of equipment.

Figure 4:
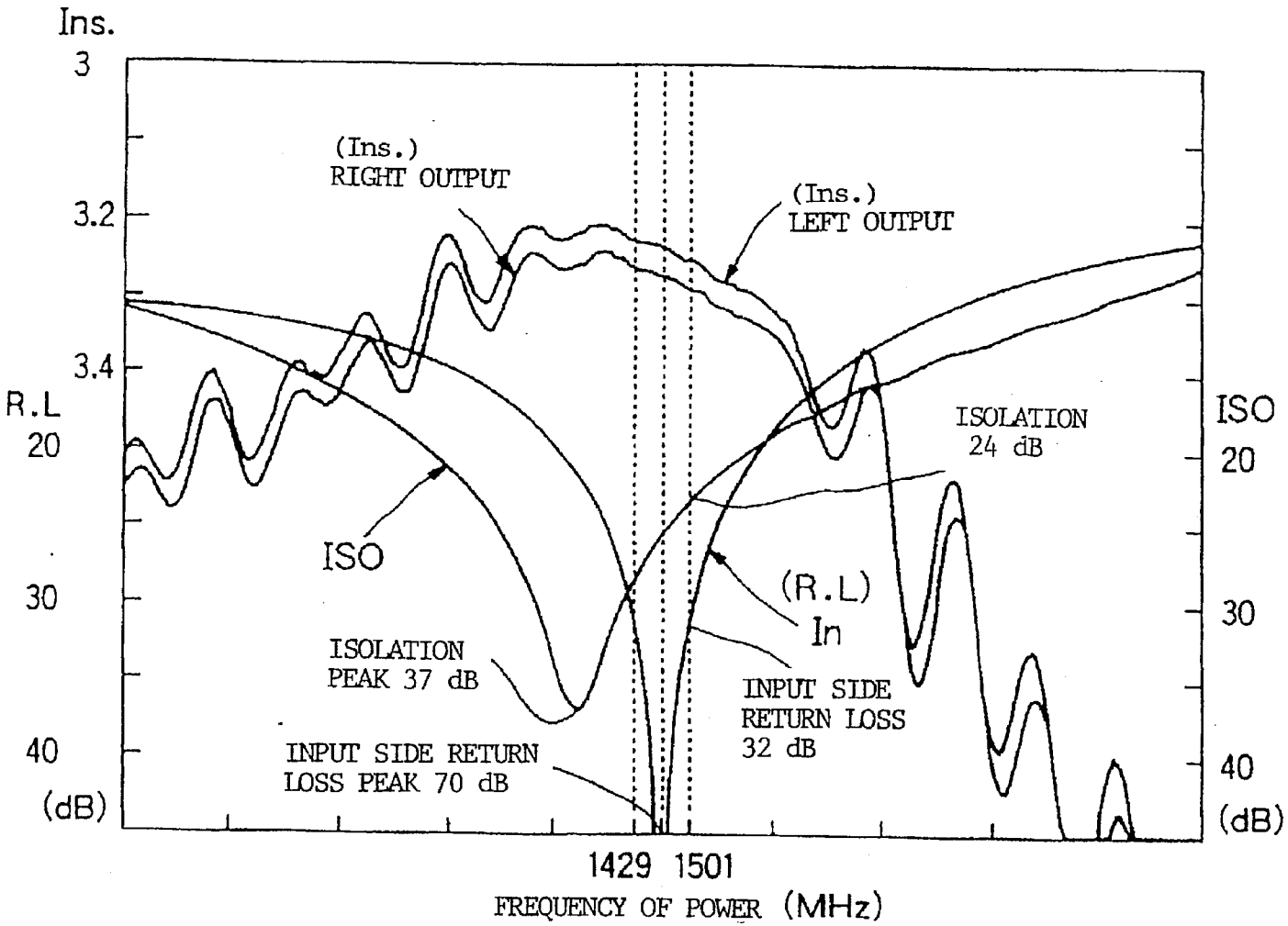
FIG. 4 is a graph showing the insertion loss, the isolation characteristic, and the return loss of a distributor with a coil equipped according to the invention.

FIG. 4 shows the insertion loss (Ins), the isolation characteristic (ISO), and the return loss (R.L) of a distributor with a coil equipped according to the invention. From FIG. 4 it is apparent that the worst value of isolation in the frequency band is improved to 24 dB and that the peak value of isolation is 37 dB. The worst value of return loss in the frequency band is improved to 70 dB. The insertion loss ranges form about 3.23 dB to about 3.3 dB, which is as good as that of the distributor without the coil 26.

The frequency band (around the peak) used is determined by the length of high-frequency transmission lines 22 and 23 ($\lambda/4$) and can be changed by changing the value of $\lambda/4$. According to the invention, it is possible to set the optimum isolation characteristic in the frequency band by changing the number of turns and the central diameter of the coil 26.

As the inductance of the coil increases, the peak of isolation shifts toward lower frequencies. Conversely, the lower the inductance of the coil, the higher the frequency of the isolation peak. As the number of turns increases, the inductance increases. Conversely, the smaller the number of turns, the lower the inductance. As the central diameter increases, the inductance decreases. Conversely, the smaller the central diameter, the higher the inductance.

Alternatively, the distributor is useful as a synthesizer by using the first terminal 11 as a synthesizing terminal and the second and third terminals 12 and 13 as input terminals, producing the same advantages.

The capacitance (C) and inductance (L) of a h-f power distributor/synthesizer using the Willkinson distributor system can be controlled by connecting a coil across the balance resistance to thereby provide the improved isolation characteristic and return loss without much adverse influence on the insertion loss.

Since it is necessary to add only a coil to the Willkinson type distributor/synthesizer, the structure is very simple and inexpensive.

By changing the central diameter and/or the number of turns of a coil connected across the balance resistor it is possible to shift the frequency at the peak of isolation or return loss.

For example, since the isolation characteristic of a h-f power distributor/synthesizer is improved in the frequency band between 1429 and 1501 MHz, the system of 1.5 GHz digital mobile phone stations can be made simple, thus reducing the system costs.

What is claimed is:

1. A high frequency power distributor/synthesizer comprising:

a first input/output terminal for high frequency power;

second and third output/input terminals for high frequency power;

a high frequency transmission line connected between said first terminal and said second terminal and between said first terminal and said third terminal;

a balance resistor connected between said second and third terminals; and a coil connected between said second and third terminals in parallel to said balance resistor to improve isolation characteristic and return loss without substantial influence on insertion loss of said distributor/synthesizer.

2. A high frequency power distributor/synthesizer according to claim 1, wherein a central diameter and a number of turns of said coil are made different for shifting a frequency of power at a peak value of said isolation characteristic or return loss.

* * * * *